United States Patent [19]

Fujii et al.

[11] Patent Number: 4,716,265

[45] Date of Patent: Dec. 29, 1987

[54] CIRCUIT BREAKER WITH ARC SHIELDED CONTACT ARM

[75] Inventors: Hiroshi Fujii; Tsukasa Iio; Yasusi Genba; Hideaki Moriwaki; Yoshinori Mochizuki, all of Fukuyama, Japan

[73] Assignee: Mitsubishi Denki Kabushiki Kaisha, Tokyo, Japan

[21] Appl. No.: 61,522

[22] Filed: Jun. 15, 1987

[30] Foreign Application Priority Data

Sep. 9, 1986 [JP] Japan ..... 61-138778[U]

[51] Int. Cl.[4] ..... H01H 33/08; H01H 9/30

[52] U.S. Cl. ..... 200/144 R; 200/305

[58] Field of Search ..... 200/144, 305

[56] References Cited

U.S. PATENT DOCUMENTS

| | | | |
|---|---|---|---|
| 4,075,446 | 2/1978 | Aadahl | 200/144 R |
| 4,459,445 | 7/1984 | Hisatsune et al. | 200/144 R |
| 4,581,511 | 4/1986 | Leone | 200/144 R |

*Primary Examiner*—Robert S. Macon

*Attorney, Agent, or Firm*—Sughrue, Mion, Zinn, Macpeak and Seas

[57] ABSTRACT

To prevent a separation arc from migrating along the movable contact arm 12 of a circuit breaker and welding its biasing spring 14, the arm is protected by an insulating shield 22 underlying its lower face, flanking its sides, and having outwardly extending tabs 22c underlying the spring halves.

4 Claims, 5 Drawing Figures

CIRCUIT BREAKER WITH ARC SHIELDED CONTACT ARM

BACKGROUND OF THE INVENTION

This invention relates to a circuit breaker provided with an arc shield which covers a movable contact arm and its contact-pressure spring.

FIGS. 1 and 2 show a conventional circuit breaker as disclosed in Japanese Kokai No. 57-79823, wherein a case or housing 1 comprises a cover 1*a* and a base 1*b*. A stationary contact arm 2 carries a stationary contact 2*a* and is fixed to base 1*b*. A frame 3 is mounted to the base by screw 4. An operating handle 5 rotates about a fulcrum point 3*a* of the frame. A cradle 6 is rotatably coupled to the operating handle. An upper link pin 7 is provided on the cradle. An over dead-center toggle or link mechanism 8 comprises an upper link 8*a* and a lower link 8*b* interlocked by a connecting pin 9. A helical tension spring 10 urges the upper link 8*a* against pin 7 by biasing the connecting pin 9 upwardly relative to the operating handle. A contact mounting arm 11 is rotatably mounted to the base 1*b* and supports a movable contact arm 12 for rotation about a shaft 13. The movable contact arm carries a movable contact 12*a*. A contact-pressure spring(s) 14 on shaft 13 biases the movable contact arm in a clockwise direction, as best seen in FIG. 2. A fixed conductor 15 is mounted to the base 1*b*, and a flexible conductor 16 is connected between the fixed conductor 15 and the movable contact arm 12. An electromagnetic device 17 having a movable iron core 17*a* is mounted to the base 1*b*. A bimetal 18 has an adjusting screw 18*a*. The core 17*a* and the adjusting screw both engage a trip bar 19, as does a latch 20. A latch 21 is disposed between the cradle 6 and the latch 20. The distal end of the lower link 8*b* is pivoted about the movable contact arm shaft 13.

In operation, when the circuit breaker is closed (not shown in the figures) current flows through the stationary contact arm 2, the engaged stationary and movable contacts 2*a*, 12*a*, the movable contact arm 12, the flexible conductor 16, and the fixed conductor 15. When the handle 15 is rotated counterclockwise to open the breaker, the connecting pin 9 of the link mechanism 8 is pulled past the dead center point and up by the helical tension spring 10, and the movable contact arm 12 is attendantly pulled up together with mounting arm 11 to separate the movable and stationary contacts. When a small but continuous overcurrent flows the bimetal 18 bends to rotate the trip bar 19 and trip the breaker in a known manner. When a sharp overcurrent spike flows the movable iron core 17*a* is actuated to rotate the trip bar and open the breaker in a similar manner.

When such a conventional circuit breaker is tripped, particularly in response to a short circuit or an overload, the arc generated tends to flash over to and along the movable contact arm and thus impair the performance characteristics of the breaker, and to weld the turns of the spring 14 together and/or to the components engaged thereby.

SUMMARY OF THE INVENTION

An object of this invention is thus to provide a circuit breaker wherein contact between the arc and the movable contact arm is prevented by providing an electrically insulating shield between the movable and stationary contact arms, around both sides of the movable contact arm, and underlying the exposed turns of the contact-pressure spring.

DETAILED DESCRIPTION OF THE PREFERRED EMBODIMENT

Figure 1:
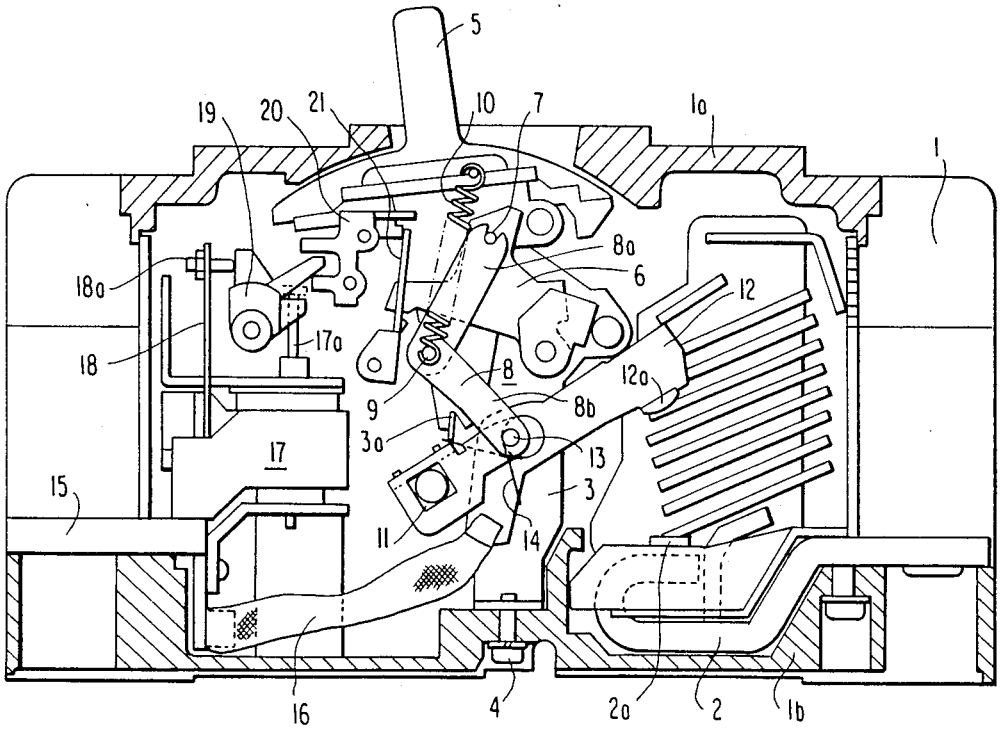
FIG. 1 PRIOR ART
FIG. 1 is a sectional side view of a conventional circuit breaker.
Figure 2:
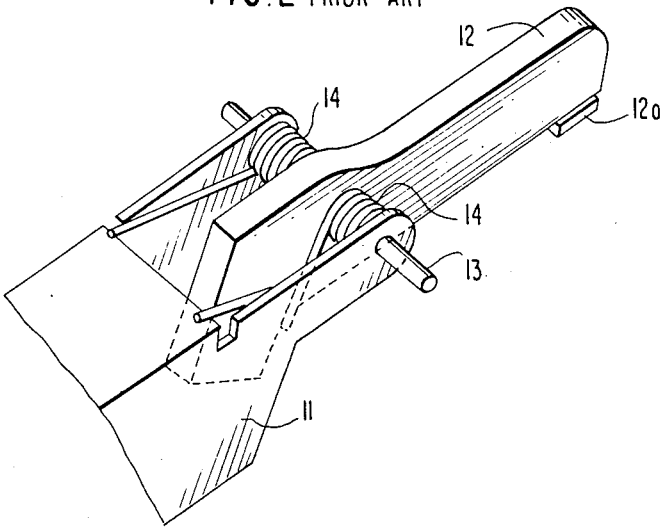
FIG. 2 PRIOR ART
FIG. 2 is a perspective view of the movable contact arm in the circuit breaker of FIG. 1.
Figure 3:
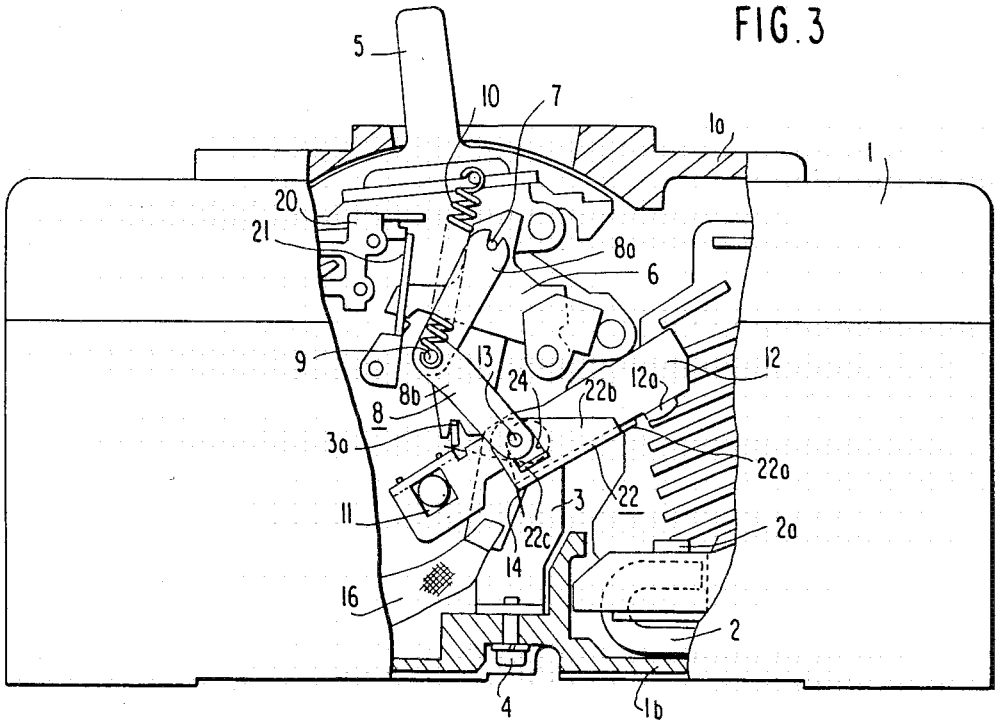
FIG. 3 is a sectional side view of a circuit breaker constructed in accordance with this invention.
Figure 4:
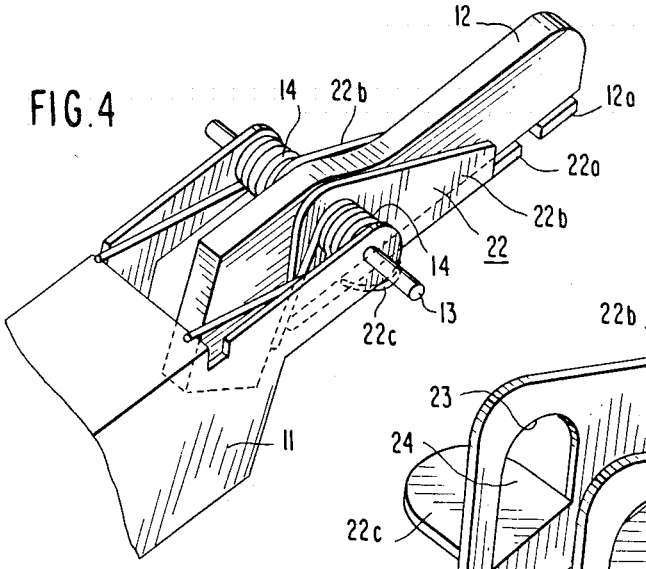
FIG. 4 is a perspective view of the movable contact arm in the circuit breaker of FIG. 3.
Figure 5:
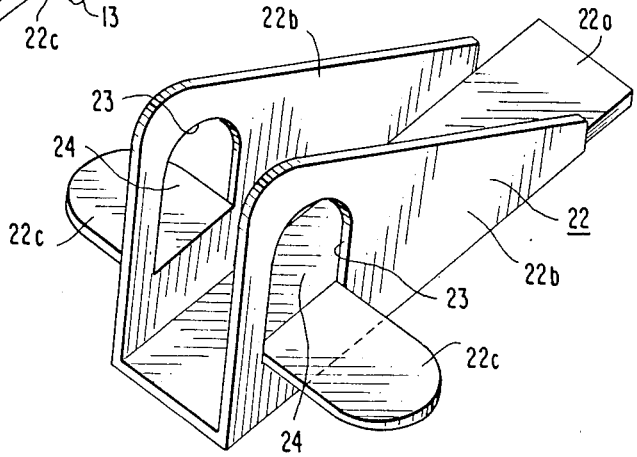
FIG. 5 is a perspective view of the shield adated to be mounted on the movable contact arm in FIG. 4.

Referring to FIGS. 3 through 5, those elements identical to those shown in FIGS. 1 and 2 are identified by the same reference numerals and their description is omitted.

In accordance with the invention, a shield 22 made of an electrically insulating, arc-resisting material such as polyamide mica paper, is installed on the movable contact arm shaft 13 during assembly. The shield comprises a base portion 22*a* underlying the stationary contact arm side of the movable contact arm 12, a pair of upstanding wing portions 22*b* which overlie the opposite sides of the contact arm, and a pair of outwardly extending tabs 22*c* which underlie the lower sides of the spring 14.

The shield 22 may be formed by bending up the wing portions 22*b* of a flat, punch pressed blank to form a U-shape as shown in FIG. 5, and then bending out the tabs 22*c* as defined by score lines 23 to leave insertion windows 24 to accommodate the contact arm shaft 13 during assembly. The two halves of the spring 14 also serve as spacers to retain the wing portions of the shield against the sides of the movable contact arm.

With both the sides and the bottom of the movable contact arm 12 protected by the shield 22 as best seen in FIG. 4, any tendency of the separation arc to migrate up the arm at the time of release is prevented. Also, any deterioration of the contact pressure due to the arc welding of the spring coils is prevented by the shield tabs 22*c*.

Although the shield has been described as being made of polyamide mica paper, a ceramic construction or the like can be used with equal effect.

What is claimed is:

1. A circuit breaker, comprising:

(a) a stationary contact arm (2) having a stationary contact (2*a*);

(b) a movable contact arm (12) having a movable contact (12*a*) for engaging with and separating from the stationary contact to close and open a current flow path;

(c) a contact mounting arm (11) for rotatably supporting the movable contact arm about a shaft (13);

(d) contact-pressure spring means (14) disposed on the shaft for biasing the movable contact arm toward the stationary contact arm; and (e) an electrically insulating shield (22) disposed on the shaft, underlying a bottom face of the movable contact arm, overlying opposite side faces thereof, and underlying the contact-pressure spring means to prevent a contact separation arc from migrating along the movable contact arm and/or welding any turns of the spring means together.

2. A circuit breaker according to claim 1, wherein the shield is made of polyamide mica paper.

3. A circuit breaker according to claim 1, wherein the shield is formed in a U-shape including a flat base portion (22*a*), a pair of wing portions (22*b*) upstanding from opposite sides of the base portion, and a pair of tabs (22*c*) individually extending outwardly from the wing portions.

4. A circuit breaker according to claim 3, wherein the tabs are punched and bent outwardly from the wing portions to leave windows (24) for accommodating the shaft.

* * * * *